US009579581B2

(12) United States Patent
Lau

(10) Patent No.: US 9,579,581 B2
(45) Date of Patent: Feb. 28, 2017

(54) SQUEEZABLE TONGUE-WAGGING TOY AND ITS SQUEEZE MECHANISM

(71) Applicant: WOW! Creations HK Limited, Hong Kong (HK)

(72) Inventor: Chun Yuen Lau, Hong Kong (HK)

(73) Assignee: WOW! CREATIONS HK LIMITED, Hong Kong (HK)

( * ) Notice: Subject to any disclaimer, the term of this patent is extended or adjusted under 35 U.S.C. 154(b) by 0 days.

(21) Appl. No.: 15/170,937

(22) Filed: Jun. 1, 2016

(65) Prior Publication Data

US 2016/0271504 A1 Sep. 22, 2016

Related U.S. Application Data

(63) Continuation-in-part of application No. 14/876,853, filed on Oct. 7, 2015, now Pat. No. 9,370,723.

(30) Foreign Application Priority Data

Oct. 8, 2014 (CN) ..... 2014 2 0582346 U

(51) Int. Cl.
*A63H 3/20* (2006.01)
*A63H 3/48* (2006.01)
*A63H 3/31* (2006.01)

(52) U.S. Cl.
CPC ..... *A63H 3/48* (2013.01); *A63H 3/31* (2013.01)

(58) Field of Classification Search
CPC ..... A63H 3/31; A63H 3/48
USPC ..... 446/129, 298, 300, 330, 341, 356, 359, 446/337, 338, 339
See application file for complete search history.

(56) References Cited

U.S. PATENT DOCUMENTS

| | | | | |
|---|---|---|---|---|
| 3,236,006 | A * | 2/1966 | Carroll | A63H 3/18 446/341 |
| 5,181,877 | A * | 1/1993 | Perkitny | A63H 3/48 446/337 |
| 5,304,087 | A * | 4/1994 | Terzian | A63H 3/365 446/337 |
| 5,876,263 | A * | 3/1999 | DeCesare | A63H 3/36 446/330 |
| 6,123,598 | A * | 9/2000 | Cook | A63H 3/18 446/337 |
| 7,524,231 | B2 * | 4/2009 | Matheny | A63H 3/00 446/129 |
| 7,901,265 | B1 * | 3/2011 | Cameron | A63H 3/46 446/330 |
| 9,370,723 | B2 * | 6/2016 | Lau | A63H 3/20 |

* cited by examiner

*Primary Examiner* — Nini Legesse

(57) ABSTRACT

A squeezable tongue-wagging toy figure with a squeeze mechanism which includes a squeaker provided within a space defined by four hinged panels in elliptical cylinder shape, and a toothed rack meshed with a gear chain that is coupled with a bar with a toy tongue. When the panels are squeezed, the rack drives the gear chain in one direction and in turn pivot the bar towards one side and the squeaker produces a sound, and when the panels are released, the rack drives the gear chain in an opposite direction and in turn pivot the bar towards an opposite side and the squeaker produces another sound.

20 Claims, 9 Drawing Sheets

SQUEEZABLE TONGUE-WAGGING TOY AND ITS SQUEEZE MECHANISM

CROSS-REFERENCE TO RELATED APPLICATIONS

This application is a continuation-in-part application of U.S. patent application Ser. No. 14/876,853 filed on Oct. 7, 2015, which claims the benefit of Chinese Utility Model Application No. 201420582346.2 filed on Oct. 8, 2014, the entire contents of all of which are hereby incorporated by reference.

FIELD OF THE TECHNOLOGY

The present application relates to a squeezable tongue-wagging toy and its squeeze mechanism.

BACKGROUND

In modern society, parents pay special attention to their children. It is indispensable for parents to choose toys for their children when they grow. With time changing and new technology being developed, new elements have been added in toys. Toys are no longer limited to motionless toys. Sounds and actions have been added, and interaction with players is possible. Existing toys with sound and interaction functions usually are very complicated and expensive. Electric motors are used to drive gears in gear boxes in order to drive the toys into action. Furthermore, speakers are required to produce sounds. As such, these toys require batteries which may be swallowed accidentally by children. Thus, these existing toys are large in size, heavy and high in manufacturing cost.

There is a need to produce a squeezable toy with squeeze and sound mechanisms which are simple in structure, light in weight, low in manufacturing cost, and does not require any motor, speaker or batteries.

SUMMARY

According to one aspect, there is provided a squeezable tongue-wagging toy including a toy figure and a squeeze mechanism mounted inside a soft body of the toy figure. The squeeze mechanism may include a front left panel and a front right panel hingedly connected by a front hinge, and a rear left panel and a rear right panel hingedly connected by a rear hinge opposite to the front hinge, the front left panel and the rear left panel being hingedly connected by a left hinge, and the front right panel and the rear right panel being hingedly connected by a right hinge opposite to the left hinge The squeeze mechanism may further include a gear chain mounted within a gearbox provided at one end of the first hinge, a toothed rack having one end fixed at the rear hinge and an opposite end slidable within the gearbox and meshed with the gear chain, and a pivotable bar. The pivotable bar may include an inner section coupled with the gear chain, an outer section extending outwardly from the front hinge and having a toy tongue formed at an outer end of the outer section, and a pivot mechanism provided between the inner and outer sections and defining a pivot axis about which the pivotable bar pivots. Squeezing the front and rear hinges inwards towards each other pushes the toothed rack forwards to drive the gear chain to turn in one direction and in turn pivot the outer section of the pivotable bar about the pivot axis towards one side, and releasing the front and rear hinges pulls the toothed rack backwards to drive the gear chain to turn in an opposite direction and in turn pivot the outer section of the pivotable bar about the pivot axis towards an opposite side, thereby simulating a tongue-wagging action.

In one embodiment, the gear chain may include a first compound gear having a first smaller gear and a first larger gear, a second compound gear having a second smaller gear and a second larger gear, and a third gear. The first smaller gear meshes with the toothed rack, the first larger gear meshes with the second smaller gear, and the second larger gear meshes with the third gear.

In one embodiment, the third gear may be formed on one surface of a disc, and an off-center shaft may be formed on an opposite surface of the disc. The off-center shaft is snugly received in a slot formed on the inner section of the pivotable bar.

In one embodiment, the pivot mechanism may include a pivot-pin hole formed on the pivotable bar between the inner and outer sections, and sleeved around a pivot shaft formed in the gearbox.

In one embodiment, the squeezable tongue-wagging toy may further include a sound-producing squeaker mounted within a space defined by the four panels. Squeezing the front and rear hinges inwards towards each other presses the squeaker and produces a first squeaking sound, and releasing the front and rear hinges releases the squeaker and produces a second squeaking sound. The squeaker may be an accordion squeaker.

In one embodiment, the toy tongue may be formed separately and attached to the outer end of the outer section of the pivotable bar. Alternatively, the toy tongue may be integrally formed at the outer end of the outer section of the pivotable bar.

According to another aspect, there is provided a squeeze mechanism for a squeezable tongue-wagging toy figure. The squeeze mechanism is mountable inside a soft body of the toy figure and may include a front left panel and a front right panel hingedly connected by a front hinge, and a rear left panel and a rear right panel hingedly connected by a rear hinge opposite to the front hinge, the front left panel and the rear left panel being hingedly connected by a left hinge, and the front right panel and the rear right panel being hingedly connected by a right hinge opposite to the left hinge The squeeze mechanism may further include a gear chain mounted within a gearbox provided at one end of the first hinge, a toothed rack having one end fixed at the rear hinge and an opposite end slidable within the gearbox and meshed with the gear chain, and a pivotable bar. The pivotable bar may include an inner section coupled with the gear chain, an outer section extending outwardly from the front hinge and having a toy tongue formed at an outer end of the outer section, and a pivot mechanism provided between the inner and outer sections and defining a pivot axis about which the pivotable bar pivots. Squeezing the front and rear hinges inwards towards each other pushes the toothed rack forwards to drive the gear chain to turn in one direction and in turn pivot the outer section of the pivotable bar about the pivot axis towards one side, and releasing the front and rear hinges pulls the toothed rack backwards to drive the gear chain to turn in an opposite direction and in turn pivot the outer section of the pivotable bar about the pivot axis towards an opposite side, thereby simulating a tongue-wagging action.

In one embodiment, the gear chain may include a first compound gear having a first smaller gear and a first larger gear, a second compound gear having a second smaller gear and a second larger gear, and a third gear. The first smaller gear meshes with the toothed rack, the first larger gear meshes with the second smaller gear, and the second larger gear meshes with the third gear.

In one embodiment, the third gear may be formed on one surface of a disc, and an off-center shaft may be formed on an opposite surface of the disc. The off-center shaft is snugly received in a slot formed on the inner section of the pivotable bar.

In one embodiment, the pivot mechanism may include a pivot-pin hole formed on the pivotable bar between the inner and outer sections, and sleeved around a pivot shaft formed in the gearbox.

In one embodiment, the squeezable tongue-wagging toy may further include a sound-producing squeaker mounted within a space defined by the four panels. Squeezing the front and rear hinges inwards towards each other presses the squeaker and produces a first squeaking sound, and releasing the front and rear hinges releases the squeaker and produces a second squeaking sound. The squeaker may be an accordion squeaker having two opposite sides and a middle accordion portion.

In one embodiment, the squeaker is provided with two opposite slide couplers formed on the two opposite sides, and slidably coupled with the panels at the front and rear hinges respectively.

In one embodiment, the toy tongue may be formed separately and attached to the outer end of the outer section of the pivotable bar. Alternatively, the toy tongue may be integrally formed at the outer end of the outer section of the pivotable bar.

In one embodiment, the four hinged panels have a shape of an elliptic cylinder in a rest position with the front and rear hinges disposed at two ends of a major axis of the elliptic cylinder respectively.

In one embodiment, the gearbox may include an outer detachable gearbox housing and an inner fixed gearbox housing.

In one embodiment, the four panels are made of plastic, and the squeaker is made of flexible plastic.

Although the squeezable tongue-wagging toy is shown and described with respect to certain embodiments, it is obvious that equivalents and modifications will occur to others skilled in the art upon the reading and understanding of the specification. The squeezable tongue-wagging toy in the present application includes all such equivalents and modifications, and is limited only by the scope of the claims.

BRIEF DESCRIPTION OF THE DRAWINGS

Specific embodiments of the squeezable tongue-wagging toy will now be described by way of example with reference to the accompanying drawings wherein.

DETAILED DESCRIPTION

Reference will now be made in detail to a preferred embodiment of the squeezable tongue-wagging toy, examples of which are also provided in the following description. Exemplary embodiments of the squeezable tongue-wagging toy are described in detail, although it will be apparent to those skilled in the relevant art that some features that are not particularly important to an understanding of the squeezable tongue-wagging toy may not be shown for the sake of clarity.

Furthermore, it should be understood that the squeezable tongue-wagging toy is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the protection.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element or is in mechanical or electrical communication with another element.

Figure 1:
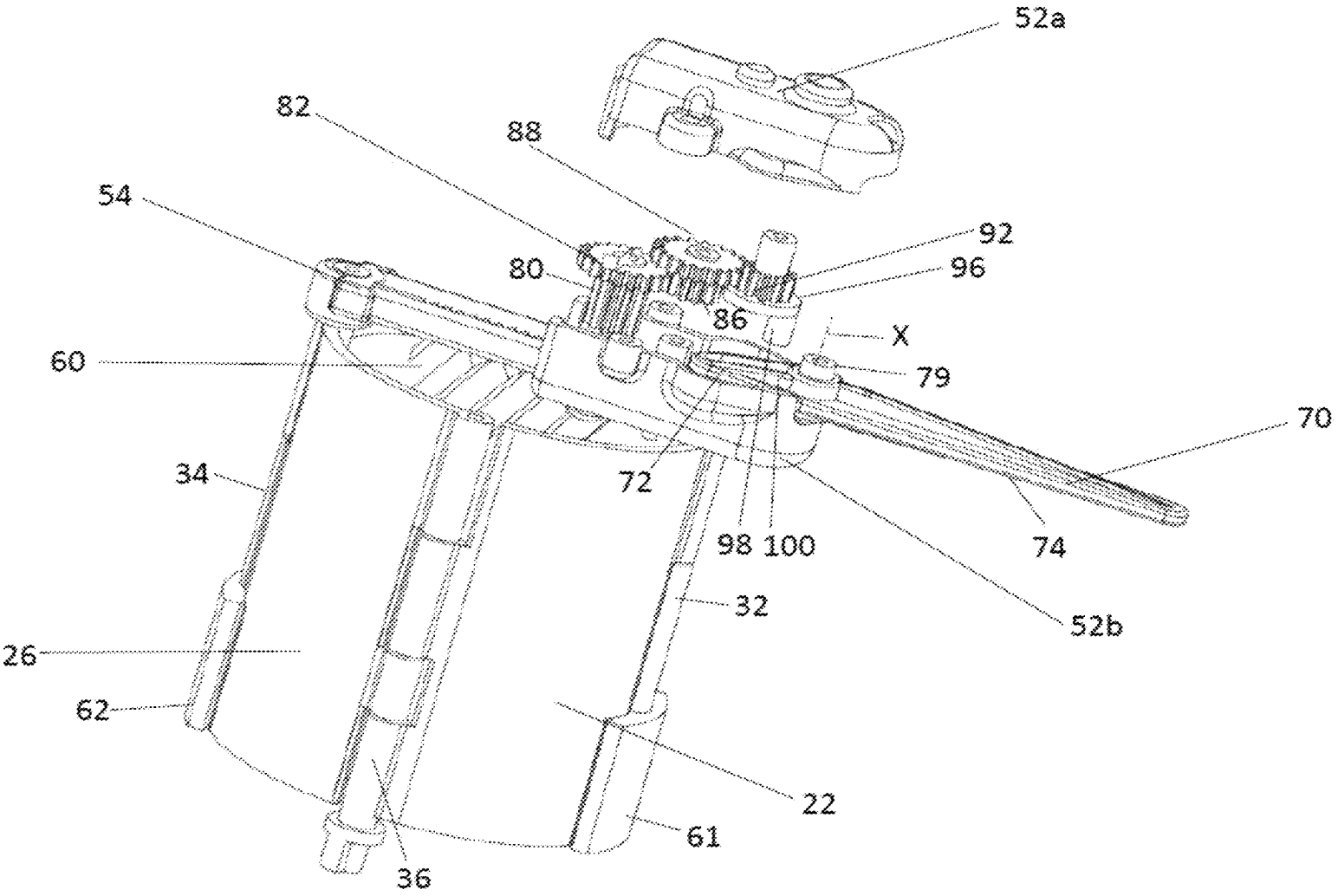
FIG. 1 is a partial exploded view of a squeeze mechanism of a squeezable tongue-wagging toy according to an embodiment disclosed in the present application.
Figures 2A, 2B:
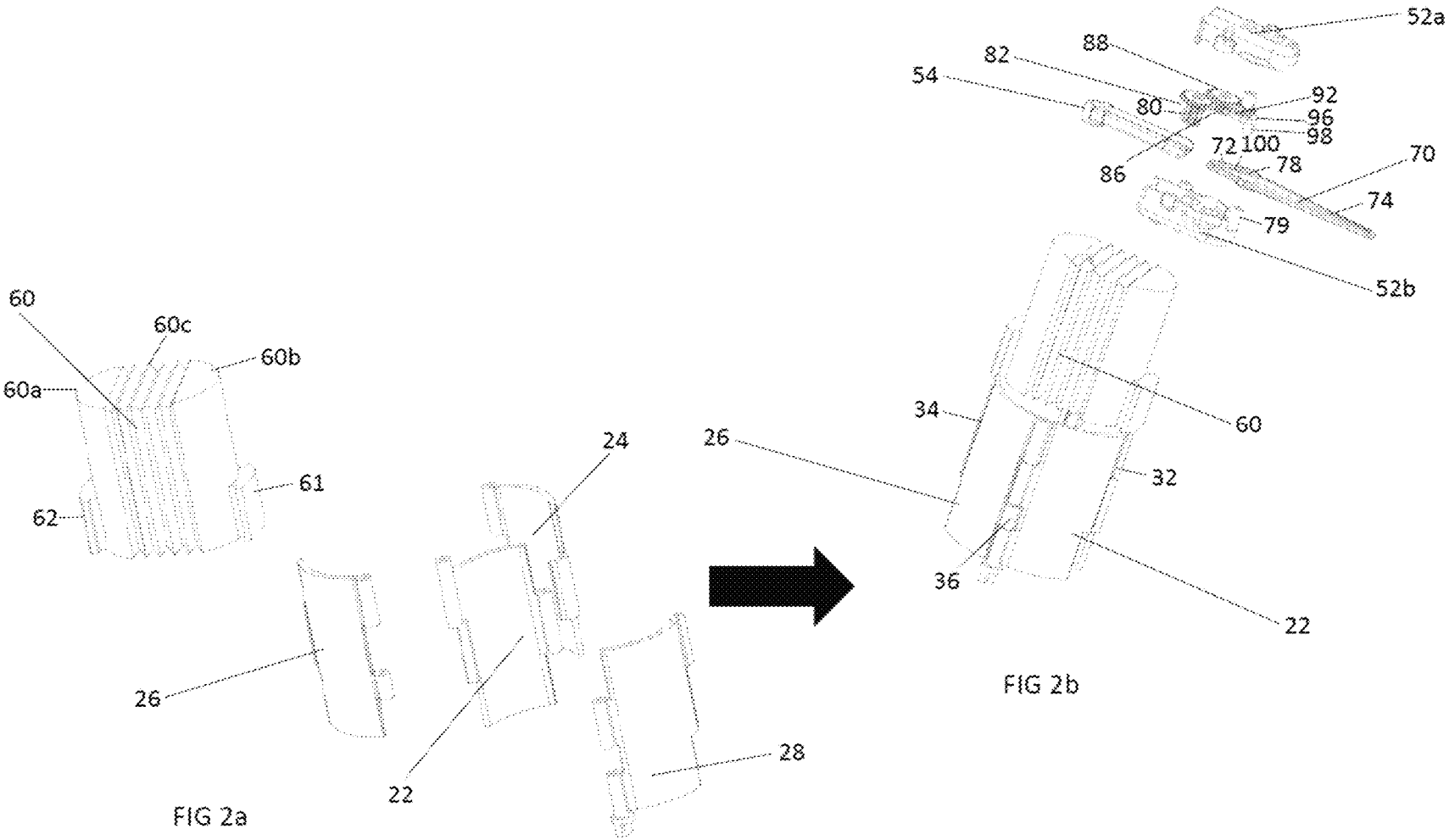
FIGS. 2*a* and 2*b* are exploded views of the squeeze mechanism of the squeezable tongue-wagging toy according to an embodiment disclosed in the present application.
Figure 3:
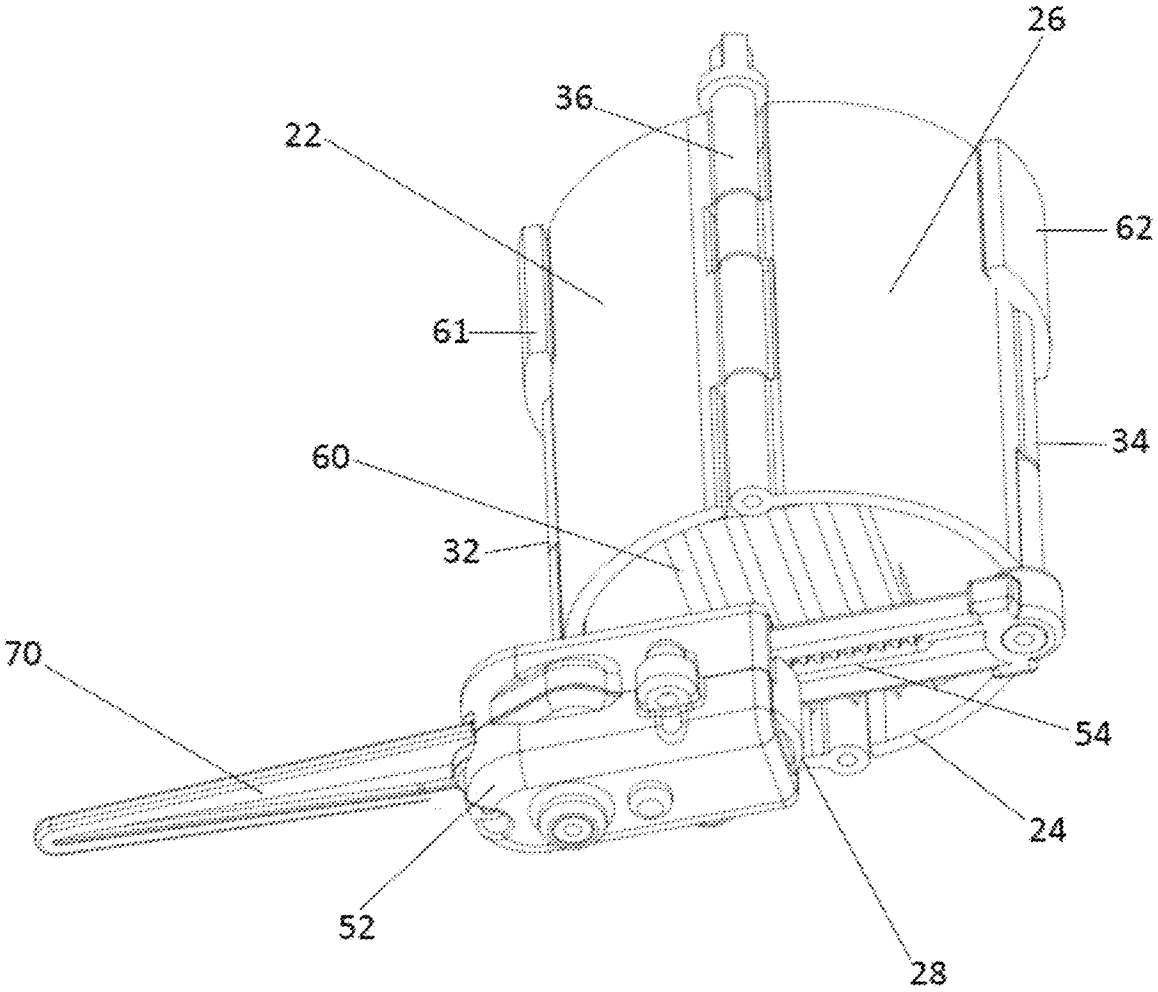
FIG. 3 is a bottom perspective view of the squeeze mechanism of the squeezable tongue-wagging toy.
Figure 5:
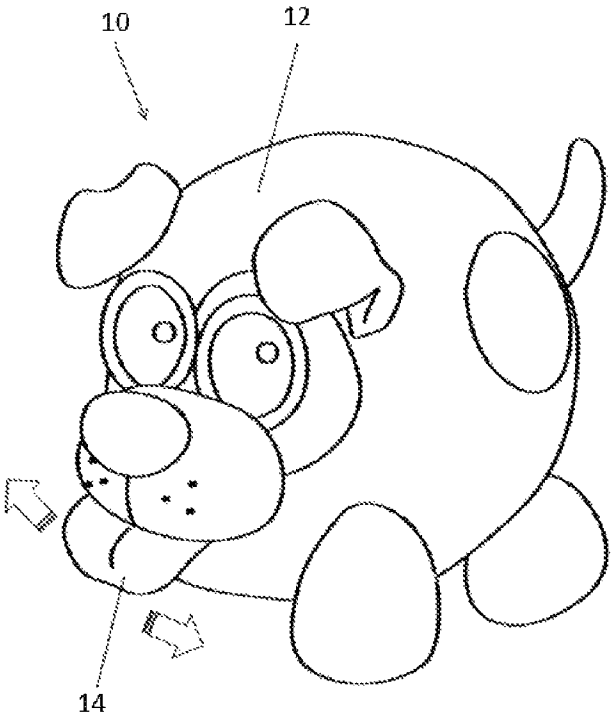
FIG. 5 is a photographic representation of the squeezable tongue-wagging toy with two arrows showing the tongue-wagging action.
Figure 4:
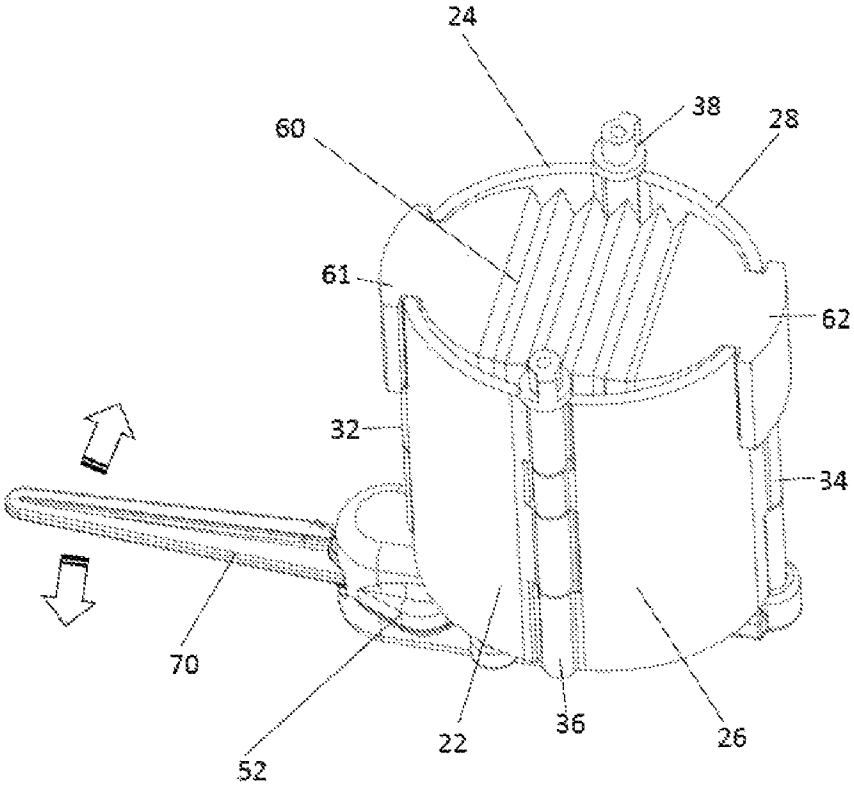
FIG. 4 is a top perspective view of the squeeze mechanism of the squeezable tongue-wagging toy.
Figure 6:
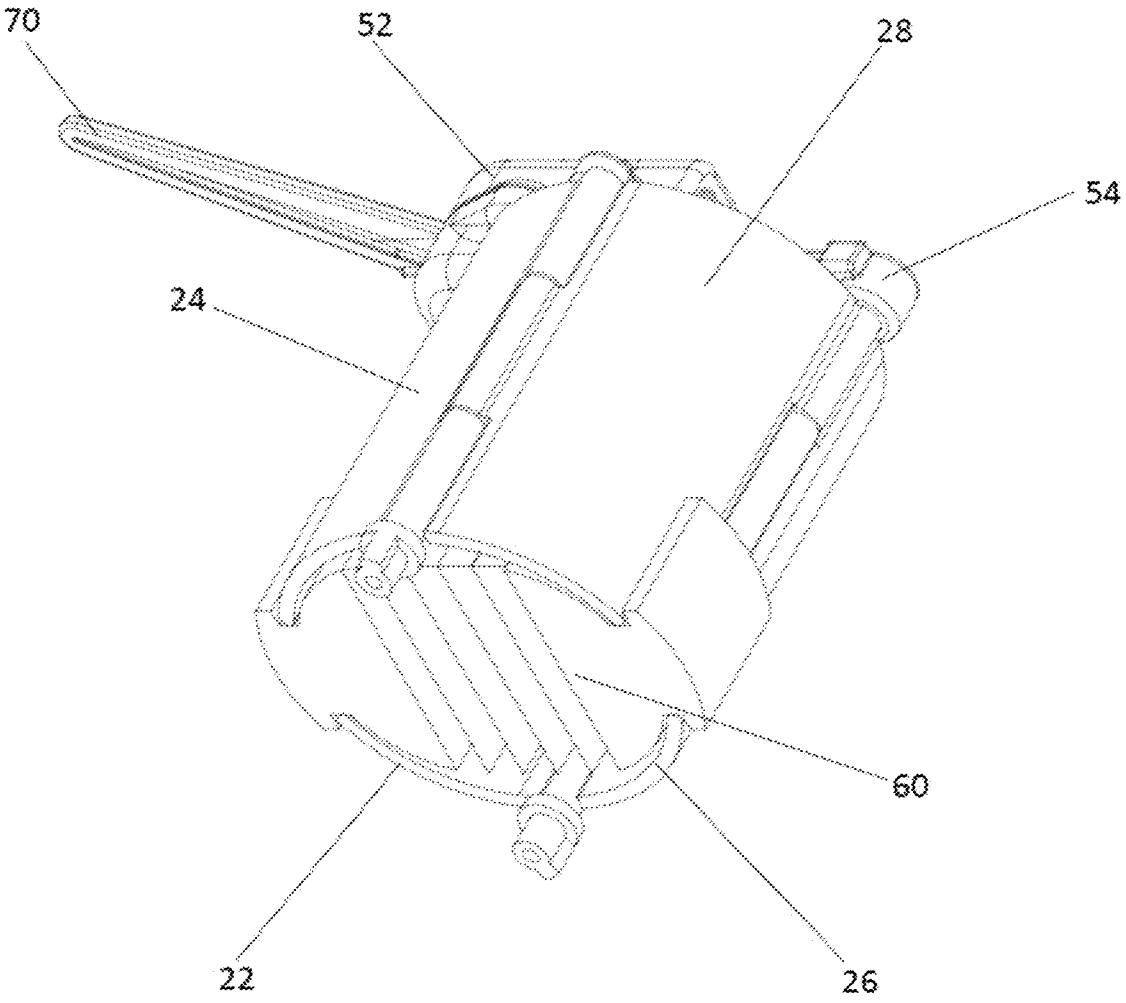
FIGS. 6-8 are further perspective views of the squeeze mechanism of the squeezable tongue-wagging toy.
Figure 7:
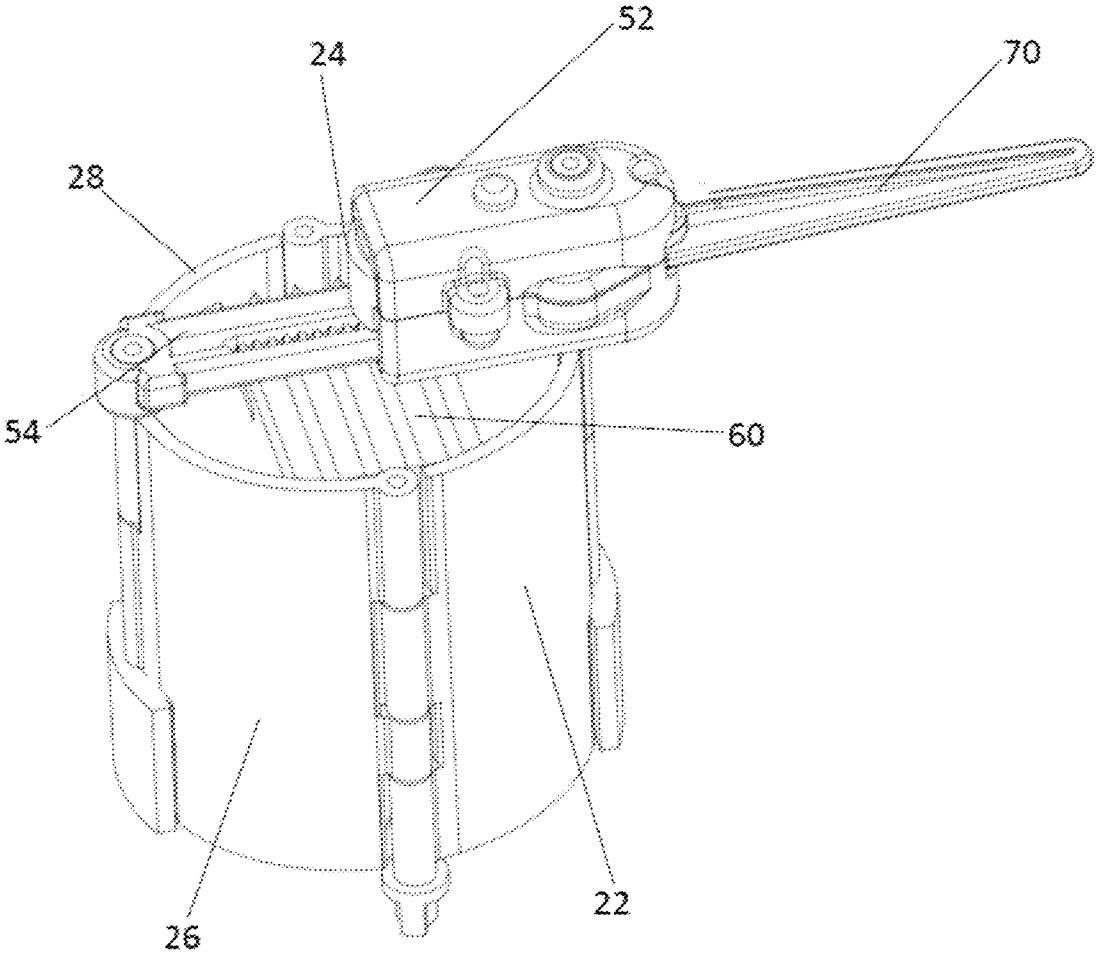
Figure 8:
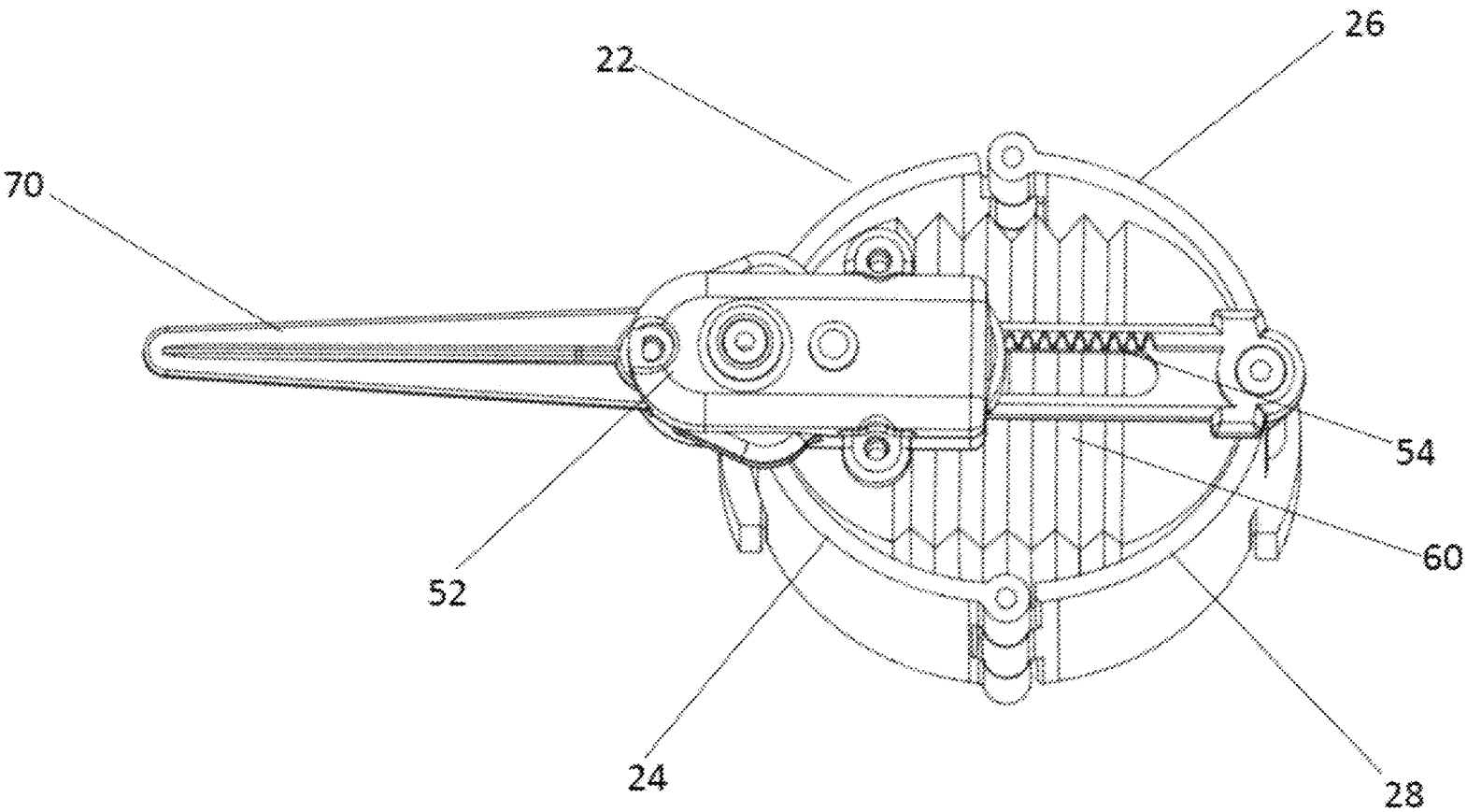
Figure 9A:
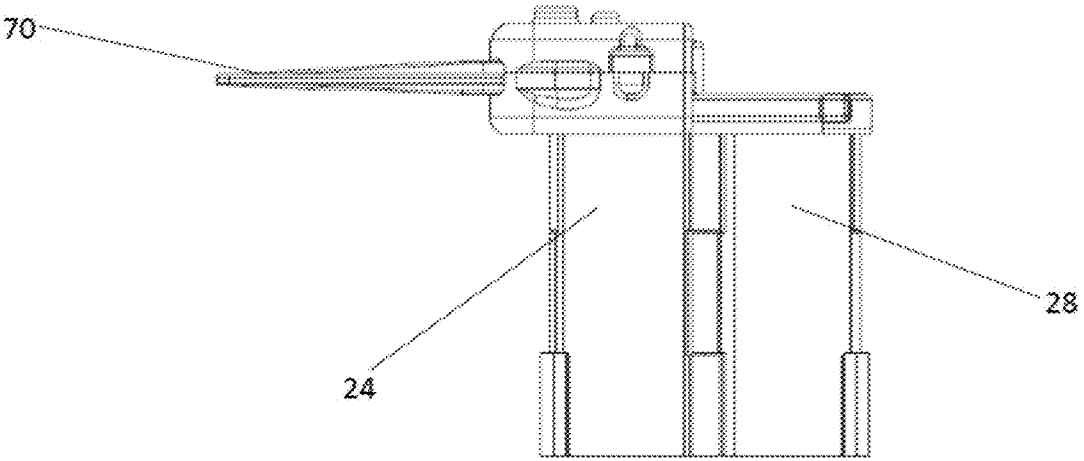
FIGS. 9*a*, 9*b* and 9*c* are side views of the squeeze mechanism of the squeezable tongue-wagging toy.
Figure 9C:
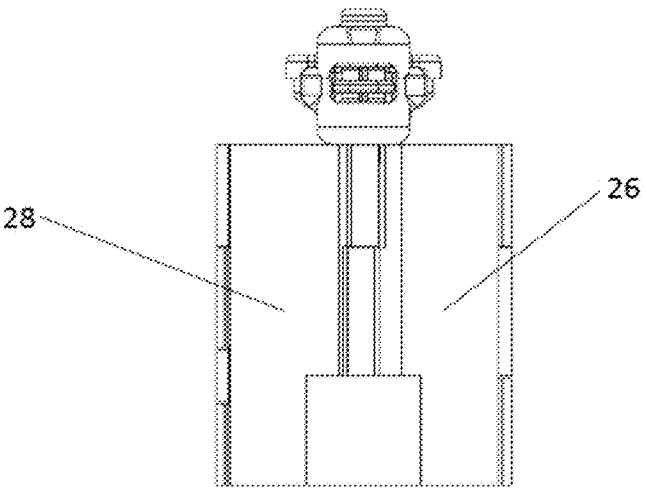
Figure 9B:
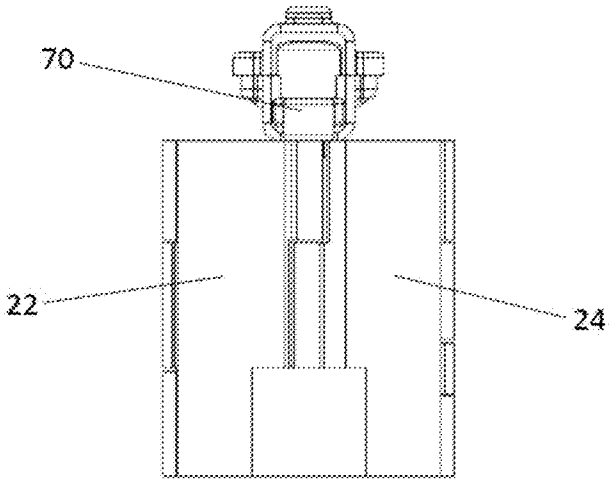

FIGS. 1-4 show different views of a squeeze mechanism 20 of a squeezable tongue-wagging toy according to an embodiment disclosed in the present application. FIG. 5 is a photographic representation of a squeezable tongue-wagging toy figure 10 having a toy tongue 14 that can wag from side to side. The squeeze mechanism 20 can be mounted inside a soft body 12 of the toy figure 10.

Figures 10A, 10B:
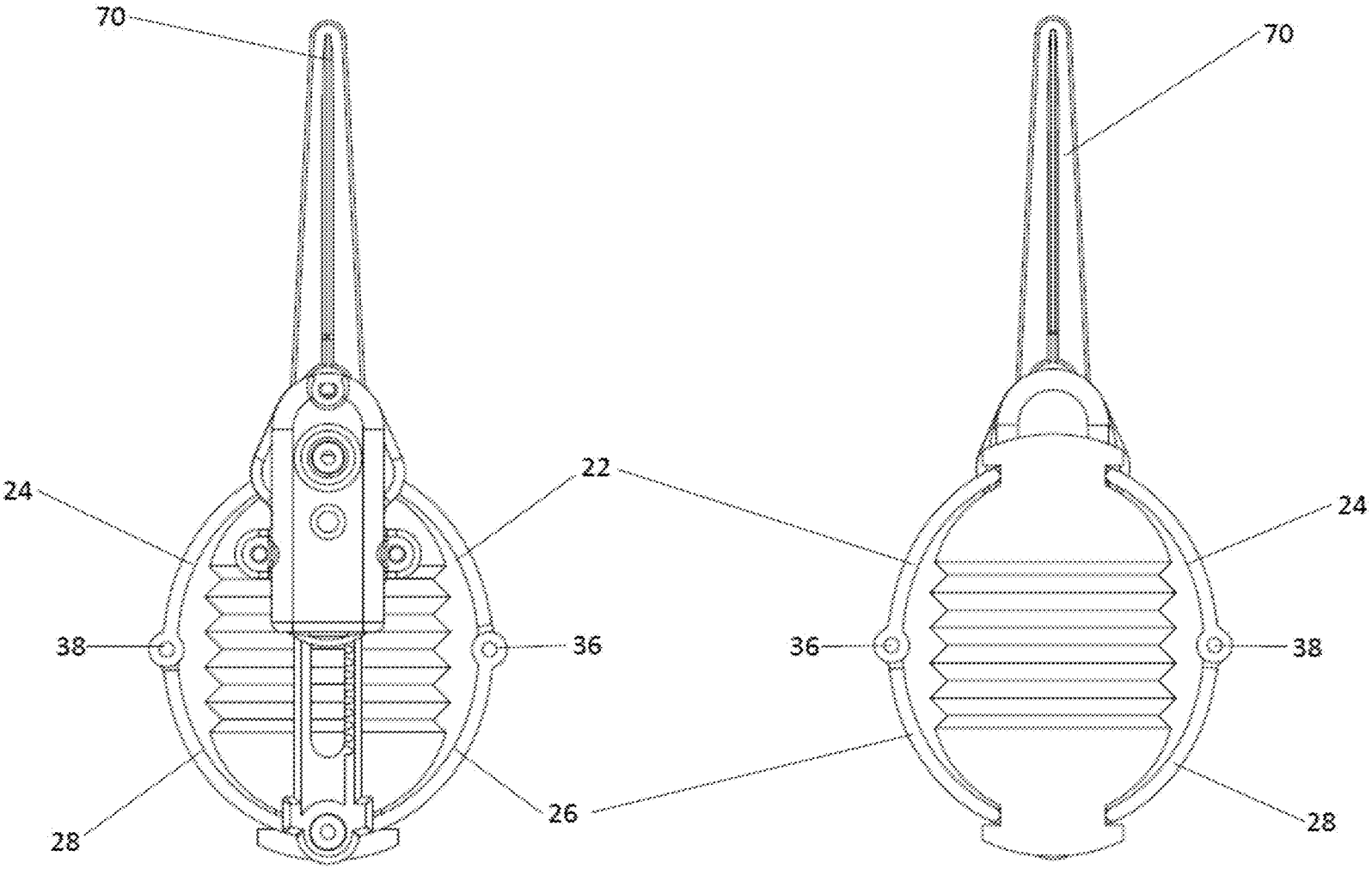
FIGS. 10*a* and 10*b* are bottom and top views of the squeeze mechanism of the squeezable tongue-wagging toy.

It is understood that the toy figure 10 can be any toy figure, whether of animals, anthropomorphized animals or humanoids, with a tongue sticking out from a face at the front of the toy figure. In the illustrated embodiment, the toy figure 10 is a toy dog. As used herein, the term "front" refers to the orientation of the toy figure where its tongue is sticking out from a face at a front side of the toy figure.

The squeeze mechanism 20 may include a front left panel 22 and a front right panel 24 hingedly connected by a front hinge 32, and a rear left panel 26 and a rear right panel 28 hingedly connected by a rear hinge 34 opposite to the front hinge 32. The front left panel 22 and the rear left panel 26 can be hingedly connected by a left hinge 36, and the front right panel 24 and the rear right panel 28 can be hingedly connected by a right hinge 38 opposite to the left hinge 36.

The four hinged panels 22, 24, 26, 28 may have a shape of an oval or elliptic cylinder in a rest position with the front and rear hinges 32, 34 disposed at two ends of a major axis of the elliptic cylinder.

The four panels 22, 24, 26, 28 and the four hinges 32, 34, 36, 38 may be made of plastic or any other suitable material. The hinges 32, 34, 36, 38 may be integrally formed on the panels 22, 24, 26, 28. Each hinge 32, 34, 36, 38 may include a pin (not shown) inserted through aligned pin holes formed on opposite-facing edges of two adjacent panels. It is understood that the hinges 32, 34, 36, 38 can be any suitable hinges that can hingedly connect a number of panels together.

The squeeze mechanism 20 may include a gear chain 50, which may be mounted within a gearbox 52. The gearbox 52 may include an outer detachable gearbox housing 52*a* and an inner fixed gearbox housing 52*b*. The inner fixed gearbox housing 52*b* can be fixed at one end of the front hinge 32.

The gear chain 50 may include a first compound gear having a first smaller gear 80 and a first larger gear 82, a second compound gear having a second smaller gear 86 and a second larger gear 88, and a third gear 92. The first smaller gear 80 may mesh with the toothed rack 54, the first larger gear 82 may mesh with the second smaller gear 86, and the second larger gear 88 may in turn mesh with the third gear 92.

It is understood that the number and size of the gears of the gear chain 50 may vary depending on the size of the toy figure 10, the desired angle of the tongue-wagging motion, etc.

The squeeze mechanism 20 may further include a toothed rack 54 which may have one end fixed at the rear hinge 34 and an opposite end slidable within the gearbox 52 and meshed with the gear chain 50.

In addition, there is provided a pivotable bar 70 which may have an inner section 72 coupled with the gear chain 50, and an outer section 74 extending outwardly from the front hinge 32 and having the toy tongue 14 formed at an outer end of the outer section 74 of the pivotable bar 70. The pivotable bar 70 may also include a pivot mechanism 76 provided between the inner and outer sections 72, 74 and defining a pivot axis X about which the pivotable bar 70 pivots.

The pivot mechanism 76 may include a pivot-pin hole 78 formed on the pivotable bar 70 between the inner and outer sections 72, 74, and sleeved around a pivot shaft 79 formed in the gearbox 52. Alternatively, the pivot shaft may be formed on the pivotable bar 70 between the inner and outer sections 72, 74, and the pivot-pin hole may be formed in the gearbox 52.

The toy tongue 14 of the toy figure 10 may be formed separately and then attached to the outer end of the outer section 74 of the pivotable bar 70. Alternatively, the toy tongue 14 may be integrally formed with the pivotable bar 70.

The third gear 92 may be formed on one surface of a disc 96. An off-center shaft 98 may be formed on an opposite surface of the disc 96. The off-center shaft 98 may be snugly received in a bore or slot 100 formed on the inner section 72 of the pivotable bar 70.

Although it has been shown and description that the pivotable bar 70 is coupled with the gear chain 50 through an off-center shaft 98, it is understood that the pivotable bar 70 can be coupled with the gear chain 50 in other possible ways. For example, the inner section 72 of the pivotable bar 70 can be formed with teeth that mesh with the third gear 92.

The squeeze mechanism 20 may further include a sound-producing squeaker 60 which may be mounted within a space defined by the four panels 22, 24, 26, 28. A portion of the squeaker 60 may extend beyond the space defined by the four panels 22, 24, 26, 28.

The squeaker 60 may be made of flexible plastic and can be produced by a blow molding process. The squeaker 60 can be squeezed and return to its original shape when the squeezing force is released. The squeaker 60 may be provided with an air passage or orifice (not shown) which allow air to flow out of the squeaker when squeezed and flow into the squeaker when released. The air passage or orifice may be provided with a vibrating metal reed that can produce a sound when air flows therethrough.

In the illustrated embodiment, the squeaker 60 is an accordion squeaker in the shape of an oval or elliptic cylinder. The accordion squeaker 60 may have two opposite sides 60*a*, 60*b* and a middle accordion portion 60*c*.

The squeaker 60 may be provided with two opposite slide couplers 61, 62 which may be formed on the two opposite sides 60*a*, 60*b* of the squeaker 60 respectively. The two opposite slide couplers 61, 62 may be slidably coupled with the panels at the front and rear hinges 32, 34 respectively such that the squeaker 60 can be held securely within the space defined by the four panels 22, 24, 26, 28.

Although it has been shown and described that the sound-producing squeaker 60 is an accordion squeaker, it is understood that the sound-producing squeaker can be any other kind of squeaker. For example, the sound-producing squeaker can be a balloon-shaped bladder or squeaker with a sound-producing feature.

Although it has been shown that the squeaker 60 may be sized and shaped to fit within the space defined by the four panels 22, 24, 26, 28, it is understood that the squeaker 60 does not need to have an exact shape and size as the space within the four panels 22, 24, 26, 28. The squeaker 60 also does not need to be in accordion shape. The squeaker 60 can be in any other shape. As long as the squeaker 60 can be placed inside the space defined by the four panels 22, 24, 26, 28, the squeaker can make a sound when squeezed or released. Moreover, it is understood that the squeaker 60 can still make a sound even only a part of the squeaker is fitted into the space within the four panels 22, 24, 26, 28.

When a player squeezes the squeezable tongue-wagging toy figure 10 at the front and rear portions thereof, the front and rear hinges 32, 34 are squeezed inwards towards each other. When the front and rear hinges 32, 34 are squeezed towards each other, the accordion portion 60*c* of the squeaker 60 collapses and produces a squeaking sound. Simultaneously, the squeezing force pushes the toothed rack 54 forwards to drive the gear chain 50 to turn in one direction (clockwise/anticlockwise). As the gear chain 50 turns, it in turn pivots the outer section 74 of the pivotable bar 70 about the pivot axis X towards one side (left/right).

When the player releases the squeezing force on the front and rear portions of the squeezable tongue-wagging toy figure 10, the collapsed accordion portion 60*c* of the squeaker 60 expands, and produces another squeaking sound. Simultaneously, the front and rear hinges 32, 34, are pushed outwards away from each other by the expanding of the accordion portion 60*c* of the squeaker 60. As the front and rear hinges 32, 34 move outwards, the toothed rack 54 is pulled backwards to drive the gear chain 50 to turn in an opposite direction (clockwise/anticlockwise) and in turn pivot the outer section 74 of the pivotable bar 70 about the pivot axis X towards an opposite side (left/right), thereby simulating a tongue-wagging action, as shown by the arrows in FIGS. 4 and 5.

FIGS. 6-10 show different view of the squeeze mechanism 20 of the squeezable tongue-wagging toy. Although it has been shown that the toothed rack 54, gear chain 50 and pivotable bar 70 are provided at a bottom end of the squeeze mechanism 50 such that the toy tongue 14 is located near a bottom side of the toy figure 10, it is understood that the toothed rack 54, gear chain 50 and pivotable bar 70 can be provided at a top end of the squeeze mechanism 50 such that the toy tongue 14 is located near a top side of the toy figure 10, as shown in FIGS. 6-10.

While the squeezable tongue-wagging toy has been shown and described with particular references to a number of preferred embodiments thereof, it should be noted that various other changes or modifications may be made without departing from the scope of the appended claims.

What is claimed is:

1. A squeezable tongue-wagging toy comprising:

(a) a toy figure (10);

(b) a squeeze mechanism (20) mounted inside a soft body (12) of the toy figure (10);

(c) the squeeze mechanism (20) comprising a front left panel (22) and a front right panel (24) hingedly connected by a front hinge (32), and a rear left panel (26) and a rear right panel (28) hingedly connected by a rear hinge (34) opposite to the front hinge (32), the front left panel (22) and the rear left panel (26) being hingedly connected by a left hinge (36), and the front right panel (24) and the rear right panel (28) being hingedly connected by a right hinge (38) opposite to the left hinge (36);

(d) a gear chain (50) mounted within a gearbox (52) provided at one end of the first hinge (32);

(e) a toothed rack (54) having one end fixed at the rear hinge (34) and an opposite end slidable within the gearbox (52) and meshed with the gear chain (50); and (f) a pivotable bar (70) having an inner section (72) coupled with the gear chain (50), an outer section (74) extending outwardly from the front hinge (32) and having a toy tongue (14) formed at an outer end of the outer section (74), and a pivot mechanism (76) provided between the inner and outer sections (72, 74) and defining a pivot axis (X) about which the pivotable bar (70) pivots;

(g) whereby squeezing the front and rear hinges (32, 34) inwards towards each other pushes the toothed rack (54) forwards to drive the gear chain (50) to turn in one direction and in turn pivot the outer section (74) of the pivotable bar (70) about the pivot axis (x) towards one side, and releasing the front and rear hinges (32, 34) pulls the toothed rack (54) backwards to drive the gear chain (50) to turn in an opposite direction and in turn pivot the outer section (74) of the pivotable bar (70) about the pivot axis (x) towards an opposite side, thereby simulating a tongue-wagging action.

2. The squeezable tongue-wagging toy as claimed in claim 1, wherein the gear chain (50) comprises a first compound gear (80, 82) having a first smaller gear (80) and a first larger gear (82), a second compound gear (86, 88) having a second smaller gear (86) and a second larger gear (88), and a third gear (92); wherein the first smaller gear (80) meshes with the toothed rack (54), the first larger gear (82) meshes with the second smaller gear (86), and the second larger gear (88) meshes with the third gear (92).

3. The squeezable tongue-wagging toy as claimed in claim 2, wherein the third gear (92) is formed on one surface of a disc (96), and an off-center shaft (98) is formed on an opposite surface of the disc (96), the off-center shaft (98) being snugly received in a slot (100) formed on the inner section (72) of the pivotable bar (70).

4. The squeezable tongue-wagging toy as claimed in claim 1, wherein the pivot mechanism (76) comprises a pivot-pin hole (78) formed on the pivotable bar (70) between the inner and outer sections (72, 74), and sleeved around a pivot shaft (79) formed in the gearbox (52).

5. The squeezable tongue-wagging toy as claimed in claim 1, further comprising a sound-producing squeaker (60) mounted within a space defined by the four panels (22, 24, 26, 28), whereby squeezing the front and rear hinges (32, 34) inwards towards each other presses the squeaker (40) and produces a first squeaking sound, and releasing the front and rear hinges (32, 34) releases the squeaker (60) and produces a second squeaking sound.

6. The squeezable tongue-wagging toy as claimed in claim 5, wherein the squeaker (60) is an accordion squeaker.

7. The squeezable tongue-wagging toy as claimed in claim 1, wherein the toy tongue (14) is formed separately and attached to the outer end of the outer section (74) of the pivotable bar (70).

8. The squeezable tongue-wagging toy as claimed in claim 1, wherein the toy tongue (14) is integrally formed at the outer end of the outer section (74) of the pivotable bar (70).

9. A squeeze mechanism (20) for a squeezable tongue-wagging toy figure (10), the squeeze mechanism (20) being mountable inside a soft body (12) of the toy figure (10) and comprising:

(a) a front left panel (22) and a front right panel (24) hingedly connected by a front hinge (32), and a rear left panel (26) and a rear right panel (28) hingedly connected by a rear hinge (34) opposite to the front hinge (32), the front left panel (22) and the rear left panel (26) being hingedly connected by a left hinge (36), and the front right panel (24) and the rear right panel (28) being hingedly connected by a right hinge (38) opposite to the left hinge (36);

(b) a gear chain (50) mounted within a gearbox (52) provided at one end of the first hinge (32);

(c) a toothed rack (54) having one end fixed at the rear hinge (34) and an opposite end slidable within the gearbox (52) and meshed with the gear chain (50); and (d) a pivotable bar (70) having an inner section (72) coupled with the gear chain (50), an outer section (74) extending outwardly from the front hinge (32) and having a toy tongue (14) formed at an outer end of the outer section (74), and a pivot mechanism (76) provided between the inner and outer sections (72, 74) and defining a pivot axis (X) about which the pivotable bar (70) pivots;

(e) whereby squeezing the front and rear hinges (32, 34) inwards towards each other pushes the toothed rack (54) forwards to drive the gear chain (50) to turn in one direction and in turn pivot the outer section (74) of the pivotable bar (70) about the pivot axis (x) towards one side, and releasing the front and rear hinges (32, 34) pulls the toothed rack (54) backwards to drive the gear chain (50) to turn in an opposite direction and in turn pivot the outer section (74) of the pivotable bar (70) about the pivot axis (x) towards an opposite side, thereby simulating a tongue-wagging action.

10. The squeeze mechanism as claimed in claim 9, wherein the gear chain (50) comprises a first compound gear (80, 82) having a first smaller gear (80) and a first larger gear (82), a second compound gear (86, 88) having a second smaller gear (86) and a second larger gear (88), and a third gear (92); wherein the first smaller gear (80) meshes with the toothed rack (54), the first larger gear (82) meshes with the second smaller gear (86), and the second larger gear (88) meshes with the third gear (92).

11. The squeeze mechanism as claimed in claim 10, wherein the third gear (92) is formed on one surface of a disc (96), and an off-center shaft (98) is formed on an opposite surface of the disc (96), the off-center shaft (98) being snugly received in a slot (100) formed on the inner section (72) of the pivotable bar (70).

12. The squeeze mechanism as claimed in claim 9, wherein the pivot mechanism (76) comprises a pivot-pin hole (78) formed on the pivotable bar (70) between the inner and outer sections (72, 74), and sleeved around a pivot shaft (79) formed in the gearbox (52).

13. The squeeze mechanism as claimed in claim 9, further comprising a sound-producing squeaker (60) mounted within a space defined by the four panels (22, 24, 26, 28), whereby squeezing the front and rear hinges (32, 34) inwards towards each other presses the squeaker (40) and produces a first squeaking sound, and releasing the front and rear hinges (32, 34) releases the squeaker (60) and produces a second squeaking sound.

14. The squeeze mechanism as claimed in claim 13, wherein the squeaker (60) is an accordion squeaker having two opposite sides (60*a*, 60*b*) and a middle accordion portion (60*c*).

15. The squeeze mechanism as claimed in claim 14, wherein the squeaker (60) is provided with two opposite slide couplers (61, 62) formed on the two opposite sides, and slidably coupled with the panels at the front and rear hinges (32, 34) respectively.

16. The squeeze mechanism as claimed in claim 9, wherein the toy tongue (14) is attached to the outer end of the outer section (74) of the pivotable bar (70).

17. The squeeze mechanism as claimed in claim 9, wherein the toy tongue (14) is integrally formed at the outer end of the outer section (74) of the pivotable bar (70).

18. The squeezable mechanism as claimed in claim 9, wherein the four hinged panels (22, 24, 26, 28) have a shape of an elliptic cylinder in a rest position with the front and rear hinges (32, 34) disposed at two ends of a major axis of the elliptic cylinder respectively.

19. The squeeze mechanism as claimed in claim 9, wherein the gearbox (52) comprises an outer detachable gearbox housing (52*a*) and an inner fixed gearbox housing (52*b*).

20. The squeeze mechanism as claimed in claim 9, wherein the four panels (22, 24, 26, 28) are made of plastic, and the squeaker (60) is made of flexible plastic.

* * * * *